US005798404A

United States Patent [19]

Monty et al.

[11] Patent Number: 5,798,404

[45] Date of Patent: Aug. 25, 1998

[54] HAIR CARE APPLIANCE WITH THERMOCHROMIC HAIR CURLERS AND METHOD OF MANUFACTURING SAME

[76] Inventors: Lawrence P. Monty; Patrick T. Monty, both of 193 Cooper Rd., Milton, Vt. 05468

[21] Appl. No.: 694,033

[22] Filed: Aug. 8, 1996

Related U.S. Application Data

[62] Division of Ser. No. 348,735, Dec. 2, 1994, Pat. No. 5,606,983.

[51] Int. Cl.[6] ..... C08K 5/01

[52] U.S. Cl. ..... 524/490; 524/491

[58] Field of Search ..... 524/484, 485, 524/486, 490, 491

[56] References Cited

U.S. PATENT DOCUMENTS

| | | | |
|---|---|---|---|
| 3,410,985 | 11/1968 | Giacchero | 219/222 |
| 3,658,071 | 4/1972 | Wise | 132/33 |
| 3,665,938 | 5/1972 | Pedersen | 132/33 R |
| 3,689,736 | 9/1972 | Meyer | 219/222 |
| 3,696,819 | 10/1972 | Jensen | 132/33 R |
| 3,706,315 | 12/1972 | Johansen | 132/33 R |
| 4,028,118 | 6/1977 | Nakasuji et al. | 106/21 |
| 4,104,327 | 8/1978 | Inoue | 524/296 |
| 4,421,560 | 12/1983 | Kito et al. | 106/21 |
| 4,425,161 | 1/1984 | Shibahashi et al. | 106/21 |
| 4,624,271 | 11/1986 | Kin | 132/39 |
| 4,666,949 | 5/1987 | Shimizu et al. | 521/114 |
| 4,678,601 | 7/1987 | Ham | 524/80 |
| 4,680,324 | 7/1987 | Malwitz | 524/72 |
| 4,756,320 | 7/1988 | Andis et al. | 132/33 R |
| 4,826,550 | 5/1989 | Shimizu et al. | 156/166 |
| 4,829,155 | 5/1989 | Fukutuka et al. | 219/222 |
| 4,851,282 | 7/1989 | Shimizu et al. | 428/283 |
| 4,929,388 | 5/1990 | Wessling | 524/81 |
| 4,957,949 | 9/1990 | Kamada et al. | 523/201 |
| 4,961,972 | 10/1990 | Shimizu et al. | 427/388.1 |
| 5,174,311 | 12/1992 | Fehrmann | 132/269 |
| 5,183,705 | 2/1993 | Birkholz | 524/484 |
| 5,262,479 | 11/1993 | Tobing | 524/505 |
| 5,297,567 | 3/1994 | Summerville et al. | 132/227 |
| 5,482,060 | 1/1996 | Barradas | 132/226 |
| 5,552,470 | 9/1996 | Kubo | 524/484 |

FOREIGN PATENT DOCUMENTS

| | | | |
|---|---|---|---|
| 898099 | 4/1972 | Canada | 132/16 |

*Primary Examiner*—Paul R. Michl

*Attorney, Agent, or Firm*—Theodore R. Touw

[57] ABSTRACT

The hair care appliance of this invention has a housing, which holds a set of hair curlers and encloses electrical heating means for heating the curlers, and has a transparent cover which covers the set of curlers and the top of the housing. Each curler has a reversibly thermochromic thermoplastic elastomeric surface layer (around which hair is to be curled) which preferably covers a mandrel portion of a thermoplastic body. The thermoplastic body has ends of larger diameter than the mandrel portion of the body, and the mandrel may be hollow. A hollow mandrel may contain a double-walled metal core, which may contain a heat-retaining material. The elastomeric surface layer is preferably molded from an thermoplastic elastomer composition containing particulate thermochromic material, which preferably comprises reversibly thermochromic dye encapsulated in micro-capsules. The thermochromic dye components are chosen to be non-toxic and environmentally benign. The combination is preferably prepared to have a complete and distinct color change at a curler temperature optimum for curl retention. The colors within the preferred curling temperature range and outside that range are easily distinguished by users, even if they suffer from red/green color blindness. Thermochromic thermoplastic elastomer (TTPE) compositions for the curler mandrel surface layer are disclosed, along with a process for preparing such compositions. Preferred processes for manufacturing the curlers using the TTPE compositions are disclosed.

9 Claims, 2 Drawing Sheets

HAIR CARE APPLIANCE WITH THERMOCHROMIC HAIR CURLERS AND METHOD OF MANUFACTURING SAME

This application is a division of application Ser. No. 08 /348,735, filed Dec. 2, 1994, now U.S. Pat No. 5,606,983.

FIELD OF THE INVENTION

This invention relates to personal care appliances, and more particularly to appliances which hold and heat hair curlers. It relates even more particularly to hair curlers having a reversibly thermochromic thermoplastic elastomer surface upon which hair may be curled, a thermochromic thermoplastic elastomer composition used for such curlers, and the processes of preparing such compositions and of manufacturing such hair curler products.

BACKGROUND OF THE INVENTION

Hair care appliances have been available, which hold and heat a hair curler or set of hair curlers for hairdressers' or consumers' own personal use in curling hair. Many such appliances have no indicators indicating whether their heaters are on or off, and most provide no indication to the user as to curler temperature or when the curlers are ready for use. Some appliances have a power-on indicator, and some have a "ready light." The temperature of the curlers is an important factor in curling hair, particularly with respect to retention of curl by the hair after curling, as described in more detail below. Thus there is a need for hair curlers and appliances which indicate to the user at a glance, whether the heaters are operating during the heating phase. There is also a need for curlers which indicate accurately when each curler is at a temperature that provides the best hair curling results, especially in retention of curl. There is also a need for curlers which indicate to the user when the curling process is complete, so that curlers are not left in place in the hair for a longer time than necessary. Since temperature can vary from one portion of a curler to another, there is a need for the temperature indication to refer to the actual surface around which the hair is curled. Materials with specific properties are required. New processes are needed for preparing such materials and using them in manufacture of curlers.

NOTATIONS AND NOMENCLATURE

Throughout this specification and the appended claims, the term "thermochromic" is used to describe a material that changes color as a result of a change in its temperature, and "reversibly thermochromic" is used in its normal meaning to denote a thermochromic material whose color returns substantially to its original color when the material's temperature is changed and then restored to an original temperature. The term "TPE" is used to mean a thermoplastic elastomer, and the term "TTPE" is used to mean a thermochromic thermoplastic elastomer. The terms "curler" and "roller" are used interchangeably except in referring to any related-art patents which may distinguish between the two terms.

DESCRIPTION OF THE RELATED ART

Various hair care appliances have been available which provide a set of hair curlers or rollers and hold them for storage and heating, using electric heating elements. Such appliances are disclosed in U.S Pat. No. 5,297,567by Summerville et al. and in Canada Patent No. 898099 by Thomas and Vernon, for example. Thomas et al., (Canadian Pat. No. 898099) disclose an electrically heated hair setter in which hair curlers are heated over posts for subsequent winding, while hot, into the hair. An optional feature provides a steady-state indicator of the readiness of the hair curlers when heated to the proper temperature. The indicator is a "curler ready" light mounted in the appliance base and operated by a secondary bi-metallic thermostat mounted on a plastic block to approximate the thermal situation of a curler. The latter patent also mentions the type of curler temperature indicator provided by a dot of thermochromic paint.

The curlers of hair care appliances are typically molded of thermoplastic materials such as polyolefins. Some curlers have bodies of open-cell foam material, such as flexible polymeric foam which holds water in its open cells, to provide moisture during the hair curling process. The foam type of curler is disclosed in various patents, including U.S. Pat. No. 4,526,184 by Caruso.

Particular hair curlers are available on the market with a "ready dot," a dot of thermochromic paint on the top end of each curler, which changes color from red to black at 65° C. to 75° C. when the curler is heated for hair curling. This thermochromic paint material may be a cuprous mercuric iodide complex in a transparent carrier, as disclosed by Pedersen in U.S. Pat. No. 3,669,938. U.S. Pat. No. 5,174,311 by Fehrmann discloses a device for shaping of human hair whereby hair is wound on curlers, and heat energy is added to the hair curlers for a predetermined short time to heat them to a predetermined temperature (preferably between 75° C. and 85° C.), after application of a permanent waving preparation. A portion of the curler may be coated with a thermo-sensitive lacquer or foil to show a distinct color change when a predetermined temperature of an external surface is reached. In U.S. Pat. No. 4,829,155, Fukutuka et al. disclose a hair styler for curling hair, comprising a hollow sealed tubular member made of a metallic material defining a heat pipe. An end of the heat pipe may be provided with a temperature display portion constituted by a thermochromic material, which displays a predetermined color when a predetermined temperature is reached. Jensen (U.S. Pat. No. 3,696,819) discloses a heat-storing hair roller having an outer plastic casing and an inner heat-storage body filled with a heat storage material. Radially directed protrusions are provided between the plastic casing and the inner body in order to compensate for the greater thermal expansion rate of the plastic casing and to maintain thermal contact. Wise (U.S. Pat. No. 3,658,071) discloses a hair curler with a bi-metallic element utilized as a temperature indicating means in conjunction with a dial arrangement to provide a range of temperatures for user selection based on personal hair and/or skin characteristics.

U.S. Pat. No. 4,957,949 by Kamada et al. discloses a thermochromic color master batch for use in a thermoplastic resin comprising a wax having dispersed in it a thermochromic granular material which is coated with a hydrophilic high-molecular-weight substance. U.S. Pat. No. 4,826,550 by Shimizu et al. discloses a process for preparing molded products of thermochromic polyvinyl chloride. U.S. Pat. No. 4,666,949 by Shimizu et al. discloses a thermochromic polyurethane rethane foam and a thermochromic composition comprising an electron-donating chromogenic material, an acidic substance, and a solvent. Kito et al. (U.S. Pat. No. 4,421,560) disclose a reversible thermochromic material which may be contained within micro-capsules and undergoes reversible metachromatism at a temperature within the range from −50° C. to +120° C. Over 200 examples are shown. The thermochromic materials of Kito et al. may be used in a printing ink, a writing instrument, a paint, a sheet, or a wrapping material. Nakasuji et al.(U.S. Pat. No. 4,028, 118) disclose a reversibly thermochromic material which exhibits metachromatism within a range from −40° C. to +80° C., and which may be occluded in fine micro-capsules. The basic thermochromic material or microencapsulated thermochromic material of Nakasuji et al. can be incorporated into a polymer to obtain a thermochromic polymer composition.

PROBLEMS SOLVED BY THE INVENTION

While various means are available for indicating approximate temperatures of hair rollers or hair-roller heating apparatus, none of the prior art has provided an accurate indication of the temperature of each roller, at the roller surface around which hair is curled, i.e. the temperature effective in the hair curling process. Furthermore, many existing temperature-indicating means for hair curling apparatus indicate approximate temperatures in various ranges encompassed by the range from about 65° C. to about 85° C., whereas experiments have indicated that the roller temperatures for optimum curl retention are higher than that temperature range. A related problem has been a lack heretofore of thermochromic thermoplastic elastomer (TTPE) materials having the desired properties for making improved hair curlers. Processes for preparing such materials and using them in curler manufacture have not previously been available.

OBJECTS AND ADVANTAGES OF THE INVENTION

An object of this invention is to provide a hair care appliance which indicates to the user at a glance whether the hair care appliance is on or off, without a pilot lamp or other discrete indicator. Another object is a hair curler which indicates to the user that the curler has reached a temperature suitable for curling hair. A particular object is a hair curler that indicates such a suitable temperature within a relatively narrow range that is especially effective for curling hair and retaining the curl after curling. A related object is a hair curler which indicates to the user that the hair curling process is complete, so that the user can remove the curler from the hair without leaving the curler in place for too short or too long a time. Another object is a set of hair curlers including various sizes, such that a user can determine when all of the curlers in the set are at temperatures suitable for use in curling hair, and also determine when each of the individual curlers is at a suitable temperature. Another object is a hair curler whose temperature indication is localized at the specific surface around which the hair is curled. A further object of the invention is a set of hair curlers, each of which can indicate to the user that its individual hair-curling process is complete, so that the user can remove each curler at an appropriate time. A further object is a hair curler which can indicate its temperature with respect to hair curling effectiveness, whether the user has normal color vision or suffers from red/green color blindness. An important object is a thermochromic hair curler which does not contain toxic substances such as mercury compounds, which might contaminate the environment when ultimately discarded. Another object is a hair curler having a substantially cylindrical reversibly thermochromic mandrel surface which also has a surface texture, surface hardness, and heat capacity especially suitable for curling of hair. A related object is an efficient and economical process for manufacturing the reversibly thermochromic hair curlers of this invention. Essential to such a process has been the object of providing a TTPE composition with the required properties, usable in such processes. Finally, other objects have been thermochromic hair curlers that combine visually attractive colors and textures with improved function to provide commercially more valuable personal care products.

These objects and advantages and others will become clear from the following description of the invention and the accompanying drawings.

SUMMARY OF THE INVENTION

The hair care appliance of this invention has a base or housing, which holds a set of hair curlers and encloses electrical heating means for heating the curlers, and has a transparent cover which covers the set of curlers and the top of the housing. Each curler has a reversibly thermochromic thermoplastic elastomer surface layer (around which hair is to be curled) which covers a mandrel portion of a thermoplastic body. The thermoplastic body has ends of larger diameter than the mandrel portion of the body and the mandrel may be hollow. A hollow mandrel may contain a double-walled metal core, which may contain a heat-retaining material. The elastomeric surface layer is preferably molded from an thermoplastic elastomer material containing particulate thermochromic material, which preferably comprises reversibly thermochromic dye encapsulated in micro-capsules. The thermochromic dye components are chosen to be non-toxic and environmentally benign. The combination is preferably prepared to have a complete and distinct color change at a curler temperature optimum for curl retention. The colors within the preferred curling temperature range and outside that range are easily distinguished by users, even if they suffer from red/green color blindness.

In a preferred process for manufacturing the curlers, a TTPE composition is prepared containing thermoplastic elastomer polymer, plasticizer, lubricant, fillers, heat- and UV-stabilizers, and a predetermined proportion of particulate thermochromic material. The particulate thermochromic material preferably comprises micro-capsules of thermochromic dye selected to have a distinct color change at a predetermined temperature suitable for curling hair. A curler body form with a hollow mandrel portion and integral end flanges is made from a thermoplastic resin. A metal core may be prepared, containing a heat-retaining material, and inserted into the hollow mandrel portion of the curler body. The above-mentioned TTPE composition is insert-molded around the molded thermoplastic curler body.

DETAILED DESCRIPTION OF THE PREFERRED EMBODIMENTS

Figure 1A:
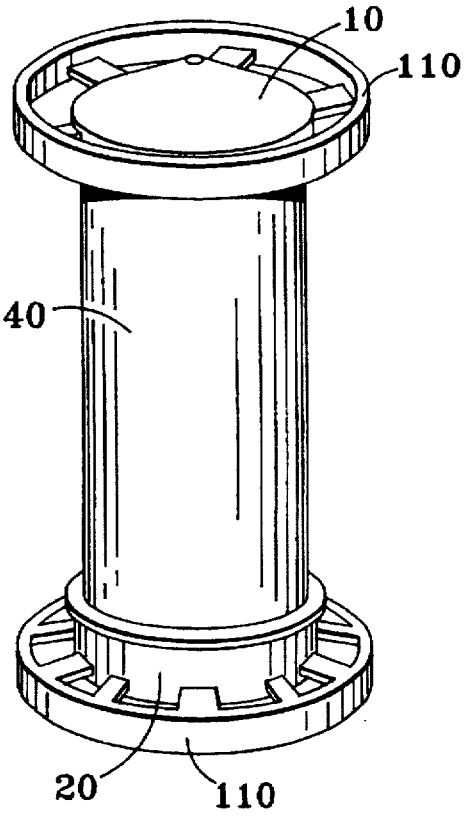
FIG. 1A shows a perspective view of a hair curler body made in accordance with the invention, in a preferred embodiment.
Figure 1B:
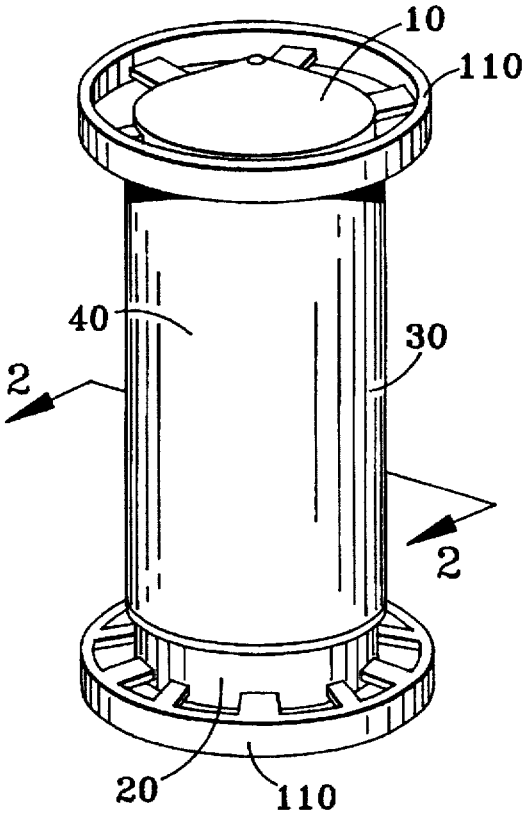
FIG. 1B shows a perspective view of a complete hair curler made in accordance with the invention, in a preferred embodiment.
Figure 2:
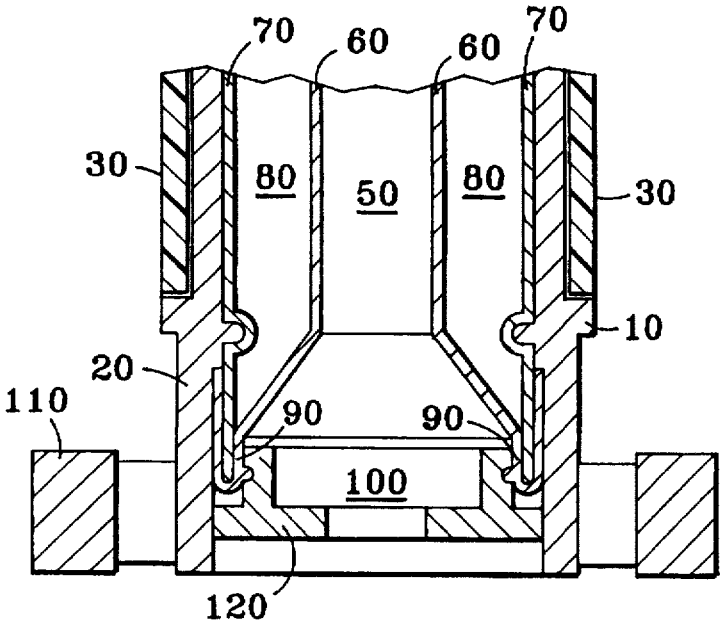
FIG. 2 shows a cross-section view of the lower portion of the hair curler of FIG. 1B, taken at section 2—2.

FIGS. 1A and 1B respectively show perspective views of two stages in the manufacture of a hair curler 10 in accordance with this invention. FIG. 1A illustrates the first of these two stages: a molded curler body 20, before addition of a thermochromic thermoplastic elastomer (TTPE) layer 30 over mandrel portion 40 of curler body 20. FIG. 1B illustrates the second of these two stages, having TTPE layer 30 in place on mandrel portion 40. FIG. 2 shows a cross-section view of the lower portion of hair curler 10 of FIG. IB, taken at section 2—2.

As shown in FIG. 2, hair curler 10 may have inserted into it a double-walled metal core element 50, having an inner wall 60 and an outer wall 70. In the annular space between inner wall 60 and outer wall 70, there may be a heat-retaining substance 80, such as a wax or the like. Heat-retaining substance 80 may be selected to have a phase change at the desired curler use temperature (i.e. the temperature at which the user's hair is curled). Inner and outer walls 60 and 70 may be joined and sealed by a rolled edge 90 after filling, as shown in the cross-section view of FIG. 2. Inner wall 60 surrounds a cavity 100, which may be adapted to fit over heating posts of a personal care appliance. In other embodiments of the invention, cavity 100 may be filled with an integral heater having electric power connectors, or may contain an induction heating coil. Neither of these known heating variations is shown in the drawings. Each curler has two integrally molded end flanges 110 having diameters larger than mandrel portions 40, and may have a cap insert 120 shaped to snap into and be retained by curler body 20 or be retained by a portion of core element 50.

In a preferred process for manufacturing the curler 10, a substantially homogeneous TTPE composition is prepared having predetermined proportions of a TPE, plasticizer, lubricant, fillers, heat- and UV-stabilizers, and a predetermined proportion of particulate thermochromic material. The particulate thermochromic material preferably comprises micro-capsules of thermochromic dye selected to have a distinct color change at a predetermined temperature suitable for curling hair. The TPE is preferably a saturated block copolymer having a polystyrene phase and a hydrogenated polyisoprene phase, or may be for example a block copolymer having a polystyrene phase and a butadiene phase, a block copolymer having a polystyrene phase and an ethylene propylene phase, or mixtures of these various copolymers.

A preferred composition has 5% to 20% by weight of the particulate thermochromic material, and even more preferred is a mixture of 10% particulate thermochromic material by weight. The particulate thermochromic material may contain any reversibly thermochromic substance which changes color distinctly within the narrow temperature range preferred for curling hair. The particulate thermochromic material preferably comprises thermochromic dye, such as a glucoside dye, encapsulated in micro-capsules. The micro-capsules should preferably have diameters of 100 micrometers or less, for effective mixing, for uniform physical characteristics, and for uniform appearance of the product. Preferred thermochromic micro-capsules contain electron-donating chromogenic substances, an electron-accepting substance, and a solvent, encapsulated with a hydrophilic high-molecular-weight polymer compound. An example of such micro-capsule material is "Chromic Color S80 Blue" (manufactured by Matsui Shikiso Chemical Co. Ltd. of Japan), which may be formulated to change color distinctly from blue to colorless when heated from room temperature (blue) to a preferred temperature range of 94° C. to 125° C., and even more preferably in a narrow range around 110° C. (colorless). With a white elastomer matrix, the mandrel portions of the curlers change from blue to white when they reach the preferred temperature range. The curlers made with these preferred materials return to their blue color when they cool to temperatures below the preferred curling range. Alternative thermochromic materials are thermochromic esters of alkoxylated methyl glucosides, thermochromic spirooxazepin-oxazine compounds, thermochromic polyacetylenes, thermochromic liquid-crystal esters, and mixtures thereof with each other or with the above-mentioned preferred thermochromic material, in appropriate formulations for the desired curling temperature range. Such thermochromic materials may also be used in combination with conventional (non-thermochromic) pigments or dyes. Any of the thermochromic materials themselves are preferably used in a micro-capsule form in the preferred size range, with the encapsulant being a high-molecular-weight polymer substantially inert to the TPE composition. Examples of suitable high-molecular-weight polymer encapsulants are polyvinyl alcohol, polyacrylic acid, gelatin, methyl cellulose or alginic acid.

An especially preferred TTPE composition comprises 100 parts of a saturated block copolymer having a polystyrene phase and a hydrogenated polyisoprene phase, 50 to 200 parts of a plasticizer oil, 0 to 200 parts of an inert particulate filler, 1 to 5 parts of an anti-oxidant and UV stabilizer, 0 to 10 parts of a lubricant, 10 to 100 parts of a thermochromic particulate material, and (optionally) 0 to 100 parts of conventional dyes and pigments. A suitable block copolymer component is "Kraton 1651 " available from the Shell Chemical Company, for example. A suitable plasticizer oil is a paraffinic or naphthalenic plasticizer oil, such as "Shellflex 371N," available from the Shell Chemical Company. Many suitable inert particulate fillers are well-known in the art. The anti-oxidants and UV-stabilizers may be "Irganox 1010" and "Tinuvin 328" available from the Ciba Geigy Corporation, for example. Examples of suitable lubricants are calcium stearate, stearic acid, palmitic acid, saturated fatty acids or their esters, or waxes. The thermochromic particulate material may be, for example, "Chromic Color S80 Blue" available from the Matsui Shikiso Chemical Company, Ltd. of Japan.

Continuing the manufacturing process, a metal core element 50 is prepared, containing a heat-retaining material 80. A curler body 20 with integral end flanges 110 is molded from a thermoplastic resin, such as polypropylene or polycarbonate. Core element 50 is inserted into curler body 20. The above-mentioned TTPE composition is insert-molded around mandrel portion 40 of the molded thermoplastic curler body 20 to a preferred thickness of between 0.5 mm and 2 mm, completing manufacture of curler 10. In an alternative embodiment, the TTPE may be insert-molded or otherwise applied to one end of curler body 20. An alternative manufacturing method would use a mandrel portion subassembly and extrusion-mold the TTPE layer onto the mandrel portion subassembly, and then fasten flange portions to the mandrel portion, for example.

A number of curlers in various sizes manufactured by the preferred process described herein were tested in a conventional personal care appliance with heating posts. As the set of curlers heated to the predetermined temperature for curling, the readiness of the set was apparent when the mandrel portions of all the curlers had changed to uniform white color. It was also apparent that the appliance was operating, although it lacked an indicator of heating power.

Figure 3:
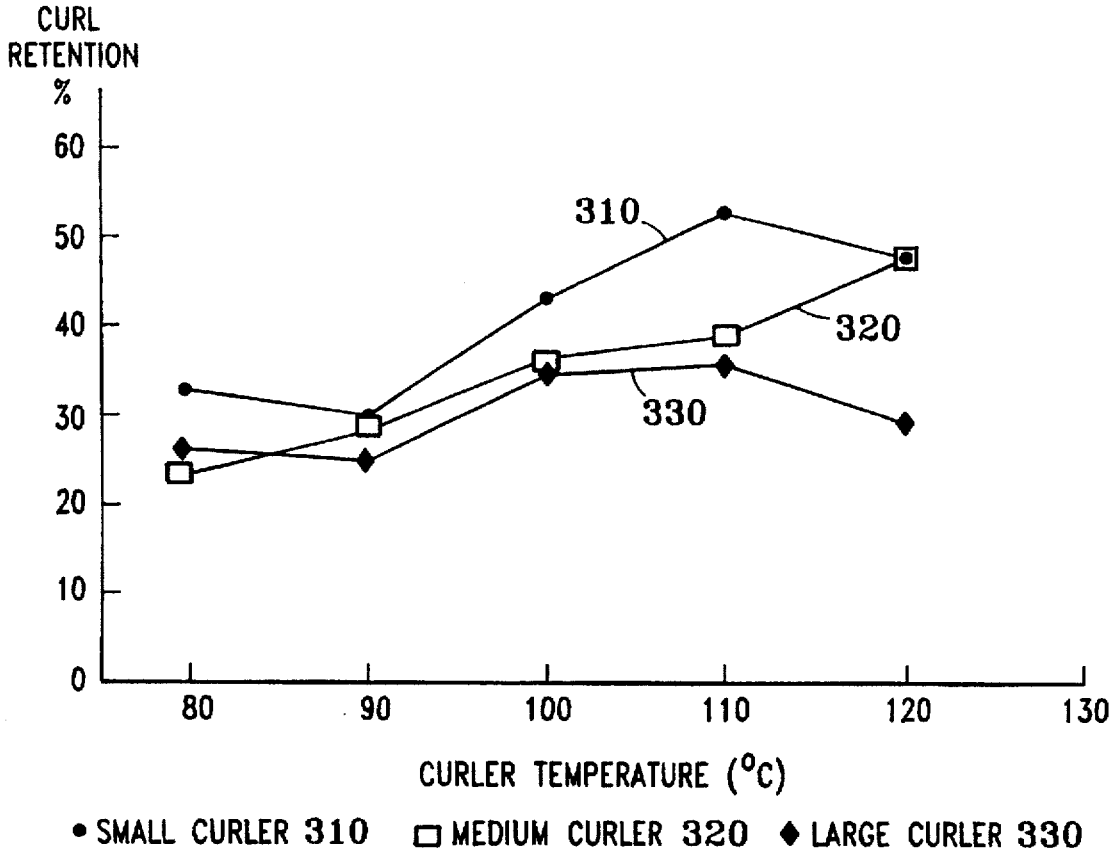
FIG. 3 shows a graph of hair curl retentiveness as a function of curler initial temperature.

FIG. 3 shows a graph of hair curl retentiveness as a function of curler initial temperature, illustrating the usefulness of the invention. Curlers of the type described in this specification were tested in three sizes: small, medium and large, corresponding to the sizes in which such curlers are commonly supplied in sets as part of a personal care appliance for curling hair. Curl retention expressed as a percentage was measured at a fixed time after curler removal (30 minutes in the case illustrated). Such measurements were made for curlers used at various initial temperatures in ° C. as shown by the abscissa of FIG. 3, and the measured percentages are plotted as the ordinate of FIG. 3. The plotted results 310, 320, and 330 show the variation of curl retention for small, medium, and large curlers respectively. These results and other similar experimental results for the same type and for other types of hair curlers and for various time periods, show that an optimum temperature range for curl retention is in the range of 94° C. to 125° C., and more particularly in a narrower range around 110° C. Thus the preferred temperature for a distinct color change in a hair curler 10 having a TTPE layer 30 over a mandrel portion 40 is a temperature around 110° C., or at least in the range of 94° C. to 125° C.

Figure 4:
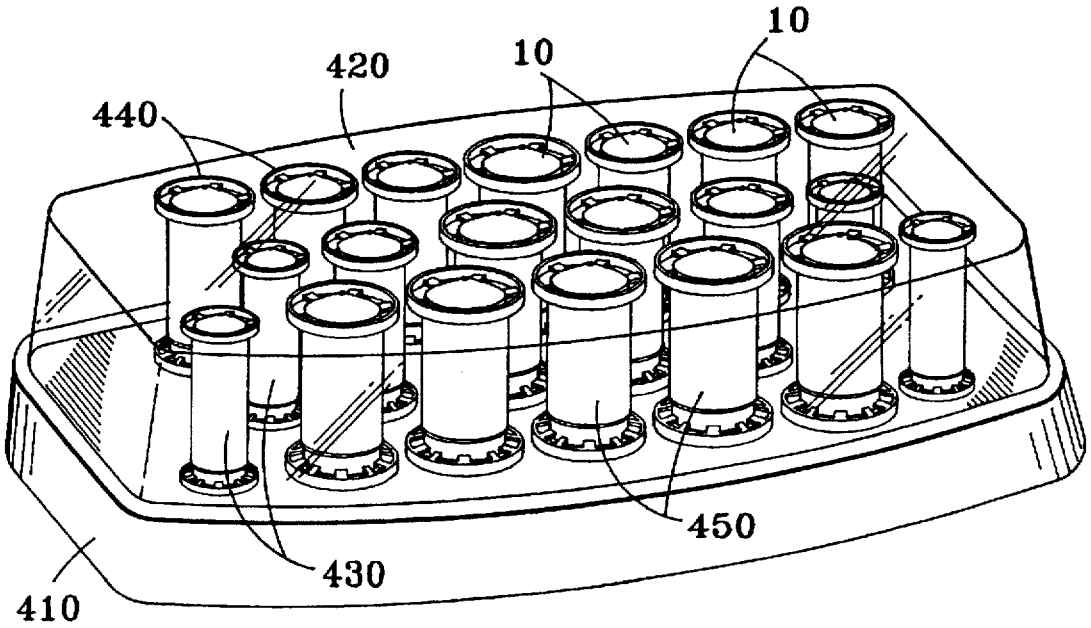
FIG. 4 shows a perspective view of a personal care appliance made in accordance with the invention.

FIG. 4 shows a perspective view of a personal care appliance made in accordance with the invention. The appliance has a base 410, and a transparent cover 420 covering a set of curlers 10 of various sizes. Each curler 10 has a reversibly thermochromic TTPE layer 30 covering at least a visible portion of its mandrel portion 40. The embodiment of FIG. 4 has three curler sizes: small (430), medium (440), and large (450) of substantially the same length, but different mandrel diameters. Base 410 contains a number of heating elements (if the curlers are of a type not having individual integral conduction heating elements or individual integral induction heating elements). It also contains conductors for conducting electrical power to the heating elements, and an insulative enclosure supporting the heating elements and enclosing at least a portion of the conductors. Selected portions of base 410 which may be heated may comprise a TTPE material of this invention, which may be insert-molded or otherwise applied to base 410.

To use the invention, a user ensures that the desired number and sizes of curlers 10 are in place on heating posts of the appliance base 410, and that cover 420 is in place. The user applies electric power to the appliance. While the curlers are heating, the user can observe that their mandrel portions 40 change color, thus indicating that the appliance is on. When the thermochromic elastomer layers 30 of all of the curlers 10 have changed to a uniform "hot" color, the curlers are ready to use. In the preferred embodiments described herein, the mandrel portions change from blue when cold to a uniform white when they have reached the optimum temperature. When the user handles curlers 10, he or she holds them by their flanges 110. The user removes transparent cover 420, selects appropriate size curlers 10, winds hair around mandrel portion 40 of each curler as desired, and waits until each curler has returned to its "cool" color, e.g. pink or blue. As each curler reaches the cool color, it may be removed gently from the hair.

Other embodiments of the invention will be apparent to those skilled in the art from a consideration of this specification or from practice of the invention disclosed herein. For example, if curlers and their appliance are to be used in conjunction with a chemical treatment of the hair (other than moisture), the optimal curling temperature may lie outside the temperature range described herein for maximum curl retention. In that case, it would be obvious to a person skilled in the art to select a thermochromic substance suitable for that optimal temperature range. It is intended that the specification and examples be considered as exemplary only, with the true scope and spirit of the invention being defined by the following claims.

Having described my invention, I claim:

1. A process for preparing a reversibly thermochromic thermoplastic elastomer molding composition, comprising the steps of:

a) mixing 100 parts of a block copolymer having a polystyrene phase and a polyisoprene phase, 50 to 200 parts of a paraffinic or naphthalenic plasticizer oil,0 to 200 parts of an inert particulate filler, 1 to 5 parts of an anti-oxidant and UV stabilizer,0 to 10 parts of a lubricant, 10 to 100 parts of a thermochromic particulate material, and optionally,0 to 100 parts of conventional dyes and pigments to form a homogeneous mixture; and b) plastic-extrusion-compounding said homogeneous mixture to produce thermoplastic elastomer pellets suitable for insert-molding.

2. A reversibly thermochromic thermoplastic elastomer molding composition comprising 100 parts of a thermoplastic elastomer, 50 to 200 parts of a paraffinic or naphthalenic plasticizer oil, 0 to 200 parts of an inert particulate filler, 1 to 5 parts of an anti-oxidant and UV stabilizer, 0 to 10 parts of a lubricant, 10 to 100 parts of a thermochromic particulate material, and optionally, 0 to 100 parts of conventional dyes and pigments.

3. A reversibly thermochromic thermoplastic elastomer molding composition as in claim 2, wherein said thermoplastic elastomer comprises a material selected from the list consisting of:

a) a block copolymer having a polystyrene phase and a polyisoprene phase, b) a block copolymer having a polystyrene phase and a butadiene phase, c) a block copolymer having a polystyrene phase and an ethylene propylene phase, and d) mixtures thereof.

4. A reversibly thermochromic thermoplastic elastomer molding composition as in claim 2, wherein said thermochromic particulate material comprises micro-capsules encapsulating within a hydrophilic high-molecular-weight compound coating, a substance selected from the list consisting of:

a) a composition further comprising:

i) an electron-donating chromagenic substance, ii) an electron-accepting substance, and iii) a solvent, b) thermochromic esters of alkoxylated methyl glucosides, c) thermochromic spirooxazepin-oxazine compounds, d) thermochromic polyacetylenes, e) thermochromic liquid-crystal esters, f) combinations thereof with each other, g) combinations thereof with conventional pigments, and h) combinations thereof with conventional dyes.

5. The process of claim 1 wherein said plasticizer oil comprises a paraffinic oil.

6. The process of claim 1 wherein said plasticizer oil comprises a naphthalenic oil.

7. A reversibly thermochromic thermoplastic elastomer molding composition made by the process of claim 1.

8. The reversibly thermochromic thermoplastic elastomer molding composition of claim 2 wherein said plasticizer oil comprises a paraffinic oil.

9. The reversibly thermochromic thermoplastic elastomer molding composition of claim 2 wherein said plasticizer oil comprises a naphthalenic oil.

* * * * *